United States Patent [19]

Griboedov et al.

[11] 3,948,211

[45] Apr. 6, 1976

[54] PLANT FOR CHROMIZING METAL ARTICLES

[76] Inventors: July Nikolaevich Griboedov, Vostochnaya ulitsa, 1/7, korpus 3, kv. 128; Boris Ivanovich Junts, Nizhegorodskaya ulitsa, 71, kv. 55; Igor Ivanovich Malaniin, bulvar Karbysheva, 22, kv. 30; Dmitry Eduardovich Kharitonovich, Sivtsev-Vrazhek pereulok, 15/25, kv. 26; Lev Alexandrovich Zherdev, Sharikopodshipnikovskaya ulitsa, 2, kv. 156; Dmitry Pavlovich Borisov, Sharikopodshipnikovskaya ulitsa, 2, kv. 195, all of Moscow, U.S.S.R.

[22] Filed: Apr. 8, 1975

[21] Appl. No.: 566,046

[52] U.S. Cl. ..... 118/48; 51/164; 118/418

[51] Int. Cl.[2] ..... C23C 13/08

[58] Field of Search ..... 118/48–49.5, 118/19, 418; 427/242; 51/164

[56] References Cited

UNITED STATES PATENTS

| | | | |
|---|---|---|---|
| 3,303,041 | 2/1967 | Thompson | 118/418 X |
| 3,812,821 | 5/1974 | Laycok | 118/418 |
| 3,858,553 | 1/1975 | Scheel | 118/421 |

*Primary Examiner*—Morris Kaplan

*Attorney, Agent, or Firm*—Haseltine, Lake & Waters

[57] ABSTRACT

A plant for chromizing metal articles, comprising: a furnace mounted on a framework tiltably about its transverse axis. Set up lengthwise within the furnace and rotatably about its longitudinal axis is a retort with two chambers and an appliance adapted to preclude the arbitrary pouring over of granular chromium-containing material from one chamber into another.

One of the chambers is fitted with a tube for supplying gas therein and another one with a reagent-supply tube and with a tube for discharging reaction products or feeding gas.

Said appliance comprises a screw secured in a retort throat and a partition arranged in front of the screw on the side of the working chamber and fitted with holes sufficient for the grains of the chromium-containing material to pass through but insufficient for the passage of articles.

Chromizing apparatus includes a horizontal mounted retort which is rotatable about its longitudinal axis, pivotal about its transverse axis and has a working chamber and an auxiliary chamber. Communication between the chambers is through a perforated plate disposed in front of a screw member relatively fixed in a reduced section of the retort; whereby in one direction of pivot and a first direction of retort rotation, the auxiliary chamber may be charged with grannular material and in the reverse directions of pivot and rotation the granular charge may be transferred to the working chamber.

4 Claims, 14 Drawing Figures

PLANT FOR CHROMIZING METAL ARTICLES

The present invention relates to plants for chromizing metal articles, such as, elements of bushing-roller chain joints diesel engine fuel apparatus and gas turbine burner nozzles.

At present metal articles are chromized in containers fitted with fuses wherein powdered chromium-containing material and articles to be treated are charged. With such arrangement all operations pertaining to the charging tightening and undoing of containers as well as those associated with articles discharge are carried out manually. Next the containers are placed into a furnace and heated slowly to a temperature at which chromizing is effected. The diffusion saturation process completed, the containers are cooled in the furnace.

However, the locking and unlocking of containers with articles require considerable time and labour input. Moreover, prolonged heating and cooling of containers in the furnace diminishes its output and increases its power requirements.

Such long heating is stipulated by the danger of ejection of the mixture owing to an increase in the volume of gases released within the containers and low thermal conductivity of the powered mixture containing aluminum oxides.

On being discharged from the furnace the containers are subjected to prolonged cooling in air, whereupon they are unlocked and the articles cleaned, rinsed and dried which is followed by heat treatment.

All this predetermines low output and high cost of the above chromizing process.

Known in the art is a chromizing arrangement.

The arrangement envisaged by the above-specified arrangement, comprises a retort accommodated within a furnace and subdivided by means of a throat into a working and an axxiliary chamber, and a valve cutting off the throat opening and rigidly connected to a water cooled rod which receives a reciprocating motion from a drive.

The arrangement is enclosed in a casing and mounted on a framework. Apart from the drive adapted to manipulate with the valve, it comprises a drive rotating the retort about its longitudinal axis and a gear for tilting it to the furnace transverse axis.

Gas is supplied along tubes to an opening in the valve an and then into the retort working chamber.

In the front portion of the retort there is a charging-discharging door closed with a cover with two tubes, of which one is adapted to discharge gaseous products and another to feed reagents by means of a movable capsule.

The chromizing process is effected in the above-described arrangement in the following manner.

A chromium-containing substance is charged into the auxiliary chamber, the valve being open at that and the retort tilted accordingly. Then both the valve and retort cover are closed. The retort, on being placed in a horizontal position, is blasted with gas and heated. Following that the cover is open and the articles to be treated are loaded into the retort working chamber. As soon as a prescribed temperature is obtained, chromium is poured over from the auxiliary chamber into the working one and reagents are fed therein. During the chromizing process the retort is rotated about its longitudinal axis.

Chromizing completed, the retort is turned with its cover upwards with the valve being partially open, and the granular chromium-containing material is poured over from the working chamber into the auxiliary one while the articles remain in the working chamber. To unload the articles the cover is open and the retort is tilted downwards.

A new batch of articles can be loaded into the retort immediately after the unloading of a preceding lot. With the above arrangement the chromizing process requires much less time and is not so expensive.

However, tests revealed inadequate reliability of the valve in service which is attributed to possible ingress of fine grains into clearances between the valve and the throat wall and between the valve rod and its guideways providing its reciprocation. It can be also put down to possible rod distortion under the effect of high temperatures.

The principal object of the present invention is to provide a plant for chromizing metal articles which would feature higher reliability in service.

Another no less important object of the invention is to provide a simplified design of an appliance adapted to preclude arbitrary pouring over of granular chromium-containing material from one chamber into another one.

Still another object of the invention is to provide improved gas supply into retort chambers, i.e. to ensure individual supply of a process and protective gas.

Yet another object of this invention is to reduce the time period for pouring over granular chromium-containing material from one chamber into another with the ensuing enhancement of the quality of chromium coating on the surface of an article and a reduction in the process duration.

Said and other objects are achieved by providing a plant for chromizing metal articles, comprising a furnace mounted in a framework tiltably about its trasverse axis and a retort arranged lengthwise in the furnace and rotatable about its longitudinal axis, said retort having a charging-and-discharging door closed with a cover and a cavity subdivided into a working and an auxiliary chamber communicating with one another through a throat, an appliance precluding the arbitrary pouring over of granular chromium-containing material through the throat opening, and tubes adapted accordingly to feed reagents and gases into the retort and to discharge gaseous products therefrom, wherein, according to the invention, said appliance is shaped as a screw secured in the retort throat and a partition disposed in front of the screw on the side of the working chamber and fitted with holes whose size is sufficient to let the grains of the chromium-containing material pass through but insufficient for the passage of articles.

The use in the herein-proposed plant of an appliance, comprising a screw fixed stationary in the retort throat, and a partition mounted in front of the screw, made it possible to provide reliable operation of the plant attributable to the obviation of the valve with travelling parts and of the reciprocating drive. The above appliances is simpler in construction and precludes arbitrary pouring over of the granular chromium-containing material through the throat opening from one chamber into another while the partition mounted in front of the screw precludes the ingress of articles from the working chamber to the auxiliary one.

It is expedient that the aforesaid appliance be made as a multiple-thread screw with each of its helices forming an angle of from 65° to 85° with the spinning axis.

The use of a multiple-thread screw makes it possible to intensify the pouring over of the grains of chromium-containing material from one chamber into another, whereas the selected angle of helix precludes arbitrary pouring of this material.

The appliance shaped as a screw is advisable to be rigidly fixed in a sleeve striking with one its end face against an annular collar that is expedient to provided on the internal surface of the retort throat, with gas-supply tubed being disposed coaxially from another end face of the sleeve and appliance, with each tube being introduced with one its end into a through hole whose cross-section varies along the longitudinal axis of the appliance, with the external tube being advisable to be supported by the recess of a wall restricting the hole, and biased with a spring on its opposite end.

The above-described attachment of the appliance screw in the sleeve locates it reliably in the retort throat and allows withdrawing it for inspection.

Coaxial arrangement of the gas-supply tubes enables individual supply of gases into the retort chambers, i.e. of a process gas into the working chamber and a neutral gas into the auxiliary chamber. This, in turn, offers a reliable protection of the granular chromium-containing material and is promising from the point of view of using the proposed plant for carrying out concurrent processes.

Moreover, coaxial attachment of the tubes allows their dismantling for inspection and cleaning.

Sleeve ends can be provided with shouldered and their outside diameter is advisable to approximate the internal diameter of the throat. This facilitates the removal of the screw-appliance from the retort throat, since the clearance between the shoulders and retort throat can receive only fine particles incapable of wedging the sleeve.

The nature of the invention will be clear from the following detailed description of a particular embodiment thereof, to be had in conjunction with the accompanying drawings, in which.

Figure 4:
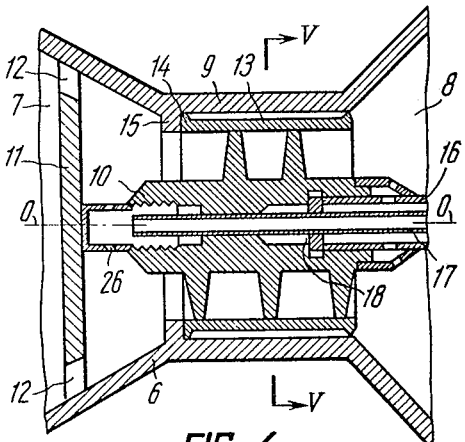
Figure 5:
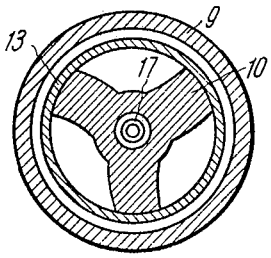
Figure 6:
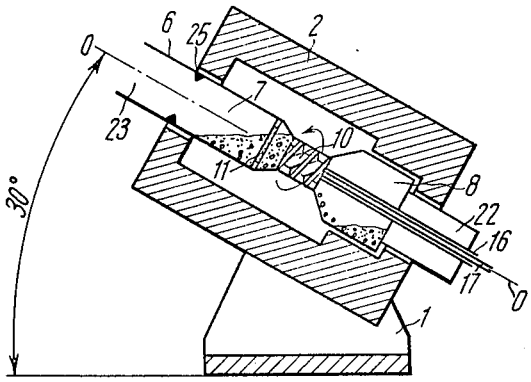
Figure 7:
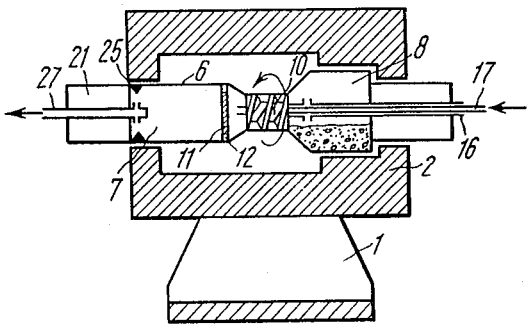
Figure 8:
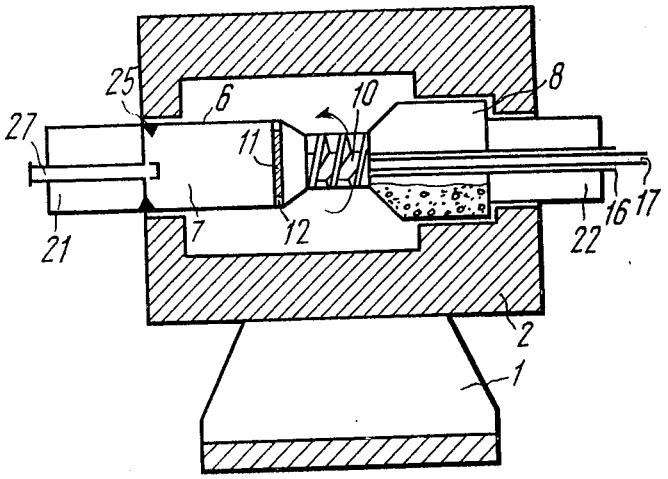
Figure 9:
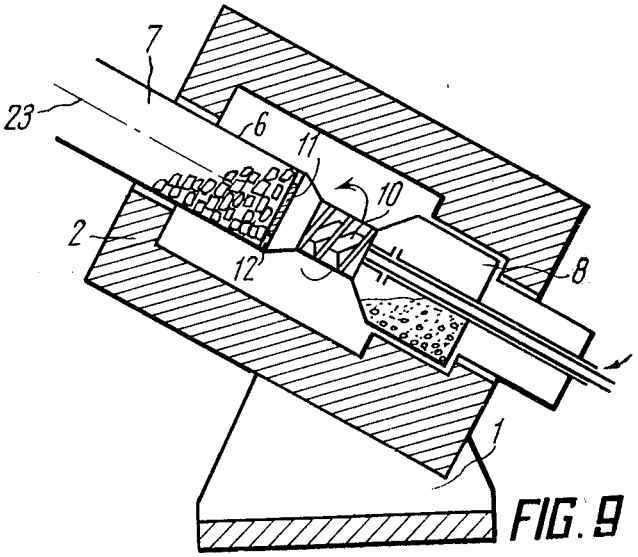
Figure 10:
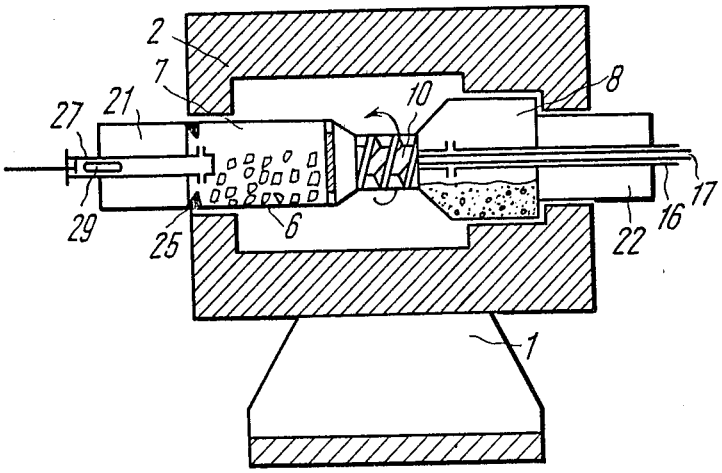
Figure 11:
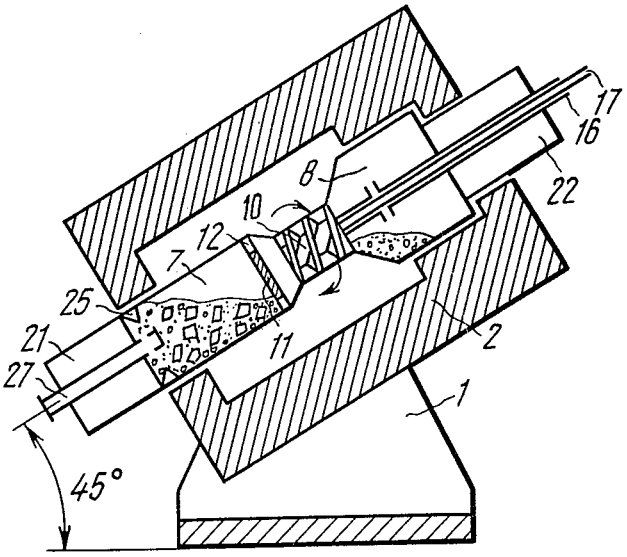
Figure 12:
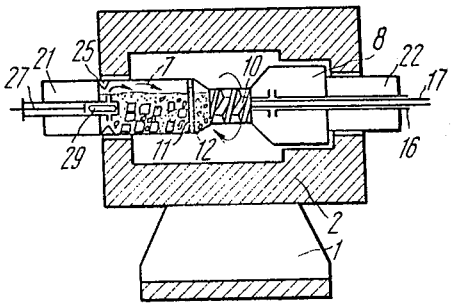
Figure 13:
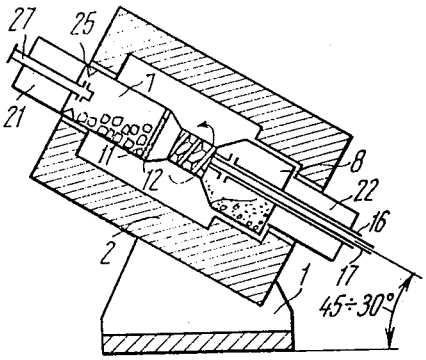
Figure 14:
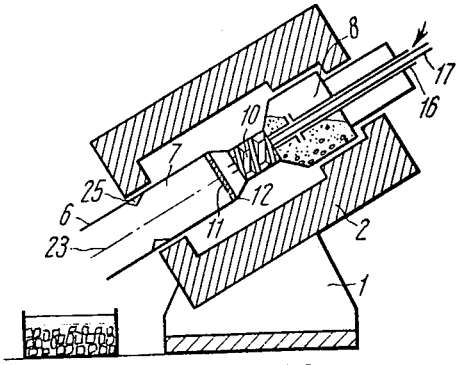

FIG. 4 presents the scaled-up appliance comprising the screw and perforated partition adapted to preclude the arbitrary pouring over of the granular chromium-containing material and of articles from one chamber into another;

FIG. 5 shows scaled up section V—V of FIG. 4;

FIG. 6 shows diagrammatically the plant set for charging the granular chromium-containing material into the retort;

FIG. 7 depicts same plant set for blasting the retort prior to heating;

FIG. 8 - same plant set for heating the retort before charging articles;

FIG. 9 - same plant set for charging articles into the retort;

FIG. 10 - same plant with the retort and articles charged therein being heated to a chromizing temperature;

FIG. 11 - same plant set for pouring over grains from the auxiliary chamber into the working one;

FIG. 12 - same plant during the chromizing process;

FIG. 13 - same plant set for pouring over grains from the working chamber into the auxiliary one;

FIG. 14 - same plant set for discharging articles from the retort.

Figure 1:
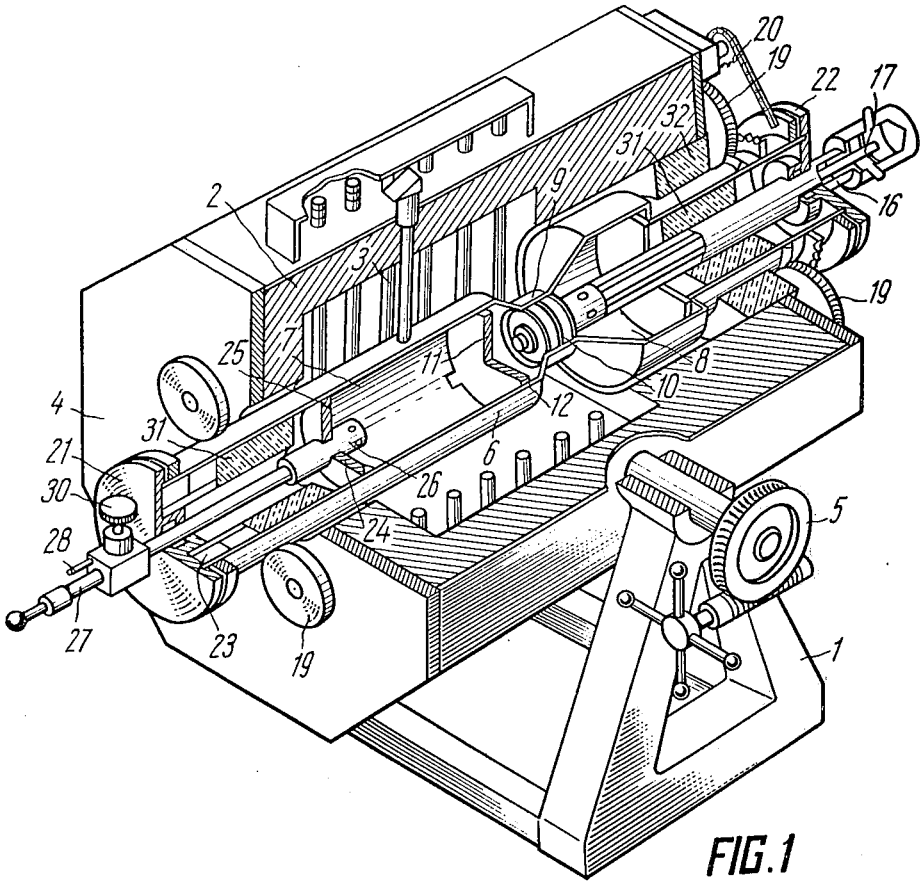
FIG. 1 is an axonometric projection of the plant, according to the invention, with a partial longitudinal cutaway and a broken-out section.
Figure 2:
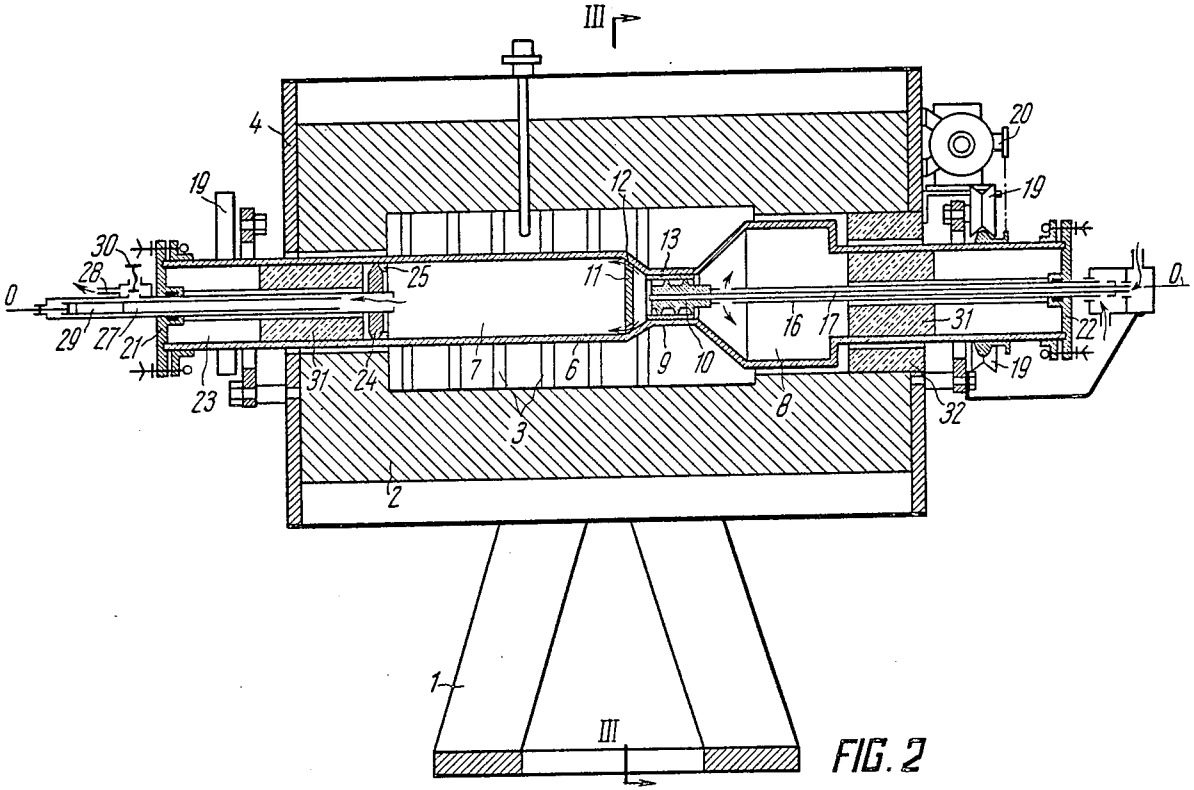
FIG. 2 is a longitudinal sectional view of the plant.
Figure 3:
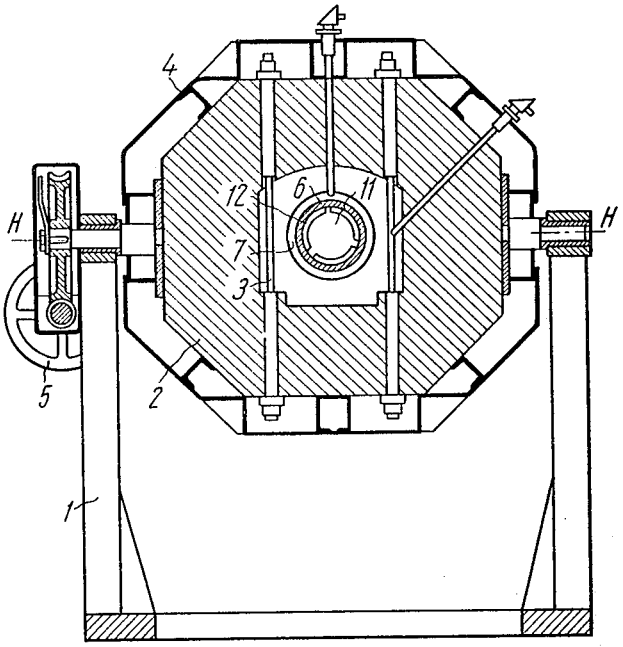
FIG. 3 shows same plant, cross-section III—III of FIG. 2.

A plant, according to the invention, comprises a framework 1 (FIGS. 1, 2 and 3) which mounts a furnace 2 lined with light-weight fireclay bricks and fitted with Silit heaters 3, with the furnace being accommodated in a casing 4 and provided with a gear 5 to tilt it to its transverse axis H—H (FIG. 3). Disposed in the space of the furnace 2 (FIG. 2) is a retort 6 with a working chamber 7 and an auxiliary chamber 8 separated by a throat 9.

Secured in the throat 9 of the retort 6 is an appliance 10 (FIGS. 4 and 5) shaped as a multiple-thread screw with helices running at an angle of from 65° to 85° to the longitudinal spinning axis O—O (FIG. 2). The appliance 10 (FIG. 4) is adapted to preclude the arbitrary pouring over a granulated chromium-containing material from chambers 7 or 8 of the retort 8 into chambers 8 or 7 accordingly, and a partition 11 provided in front of the screw on the side of the working chamber 7 and fitted with holes 12 whose size is sufficient to let the grains pass through and insufficient for the passage of articles to be treated precludes the ingress of the articles into the auxiliary chamber 8. The partition 11 is rigidly fixed in the retort 6.

The above appliance 10 can be secured tightly in a sleeve 13 (FIG. 5) fitted with shoulders 14 (FIG. 4) and thrusting against an annular collar 15 in the throat 9 of the retort 6.

To facilitate the removal of the appliance 10 and its inspection the outside diameter of the shoulders 14 of the sleeve 13 is almost equal to the inside diameter of the throat 9 of the retort 6. This prevents coarse grains, most dangerous from the point of view of wedging up, from getting into the clearance between the sleeve 13 and throat 9. On the side of the auxiliary chamber 8 (FIG. 1) gas-supply tubes 16 and 17 are disposed coaxially, extending with one end into a through hole 18 (FIG. 4) of a variable cross-section provided in the appliance 10.

The external tube 16 for supplying neutral gas into the auxiliary chamber 8 thrusts with one end against an annular recess of the wall restricting the hole in the appliance 10 in the retort 9, another end of the tube 16 being biased with a spring. The internal tube 17 for supplying process gas into the working chamber 7 does not communicate with the external tube 16.

The retort 6 is mounted on rollers 19 (FIG. 1) and fitted with a rotating drive 20. Both its end faces are provided with sealing covers 21 and 22 of which the front cover 21 closes the charging-and-discharging door 23 of the retort 6 and is furnished with a self-aligning lock 24 urged tightly by a spring (not shown in the drawing) to an annular projection 25 of the retort 6 to preclude the ingress of fine grains into the charging-and-doscharging door 23 of the retort 6. To this end the ends of the tubes 16 and 17 extending into the retort chambers are closed with caps 26.

The front cover 21 has two tubes 27 and 28 passing there-through, of which one (tube 27) is adapted for feeding reagents (halogen or halide) accommodated in a capsule 29 (FIG. 2). When the capsule 29 is heated, reagent fumes are released therein and fed into the working chamber 7 of the retort 6.

Another tube 28 with a cock 30 passes through the same cover 21 and is adapted for discharging gaseous products. Both covers 21 and 22 are fitted with heat-insulation inserts.

For treating small articles a perforated drum (not shown in the drawing) can be built-in the working chamber 7 of the retort 6, with the articles being loaded into the drum.

The face insertion piece (FIG. 1) of the furnace 2 is made from a heat-insulation material and can be removed when the retort 6 is to be withdrawn from the furnace 2.

When in a semicontinuous cycle, the plant for chromizing metal articles operates in the following manner.

With the cold startup the grains of a chromium-containing material are loaded into the auxiliary chamber 8 (FIG. 6) of the retort 6 through its charging-and-discharging door 23 prior to furnace heating. To provide for the transfer of the grains in a prescribed direction the retort is tilted at an angle of 30° to the transverse axis H—H (FIG. 3), with the charging door facing upwards, and is rotated about the longitudinal axis O—O (FIG. 6). After the grains have poured over from the chamber 7 into the chamber 8, the retort 6 is set up horizontally, closed with the cover 21 (FIG. 7) and said chambers 7 and 8 are blasted with natural gas. As soon as blasting is completed and air enclosed within the retort 6 is expelled therefrom, heating is initiated (FIG. 8). To this end the cock 30 (FIG. 1) mounted on the tube 28 for discharging gaseous products from the retort 6 is closed, whereupon a high positive pressure is developed therein, said pressure being adjusted by means of a hydraulic seal (not shown in the drawing) provided on a gas control panel (not shown in the drawing).

As soon as the retort 6 is heated to a temperature ranging from 650° to 900° C, it is set for charging. To this end it is blasted with natural gas, the cover 21 is removed and the retort 6 is turned with its charging-and-discharging door 23 (FIG. 9) upwards.

Articles to be coated with chromium are loaded into the working chamber 7 of the retort 6, then the cover 21 is closed (FIG. 1) and the retort 6 is again set to a horizontal position. Heating continues until a temperature needed for chromizing is attained. At the same time the retort 6 is blasted with natural gas. For that purpose the cock 30 (FIG. 1) is open for a certain time to be then closed again. Upon filling the retort 6 with natural gas, the granular chromium-containing material is poured over from the auxiliary chamber 8 (FIG. 11) into the working chamber 7. To this end the retort 6 is reversed with the help of a reversing drive 20 and tilted with its charging end downwards at an angle of about 45° to the horizontal axis.

In this case the appliance 10 provides not only the pouring over the grains from the auxiliary chamber 8 into the working chamber 7 but precludes their arbitrary pouring back when, upon completion of the pouring operation, the retort 6 (FIG. 12) is placed in a horizontal position in which it remains during the entore chromizing process.

Reagents needed for providing an active chromizing atmosphere are introduced in requisite amounts with the aid of the capsule 29 (FIG. 2) after the articles to be treated have intermixed with the granular chromium-containing material.

In this case the pressure within the retort 6, increased owing to the volatilization of the reagents, exceeds the atmospheric value only slightly, since excess gaseous products are expelled through the above-mentioned hydraulic seal (not shown in the drawing).

Chromizing completed, the granular material should be separated from the articles and poured over from the working chamber 7 into the auxiliary chamber 8. At the same time the retort 6 with the articles is cooled to a temperature needed for hardening.

To effect the above-mentioned operation the direction of rotation of the retort 6 is reversed (FIG. 13) with the help of the reversing drive 20 (FIG. 1) with the gear 5 (FIG. 7) turning the retort 6 concurrently upwards at an angle of 45° – –30° to the furnace transverse axis H—H so that its charging door is facing upwards.

After the granulated material has been separated from the articles by means of the appliance 10, the retort 6 is returned into its horizontal position and simultaneously blasted with neutral gas. Next, the cover 21 (FIG. 1) is removed, the rotating drive 20 of the retort 6 (FIG. 14) is cut off and the retort is tilted with its charging-and-discharging door downwards to unload the articles. When the articles are being discharged, the retort 6 is stopped to preclude the pouring over of the granulated material from the auxiliary chamber 8.

When operating in a semicontinuous cycle the next batch of articles to be coated with chromium is charged directly into the heated retort 6 (FIG. 9), as outlined above.

Tests were conducted on a plant with a working chamber 200 mm in diameter equipped first with a valve and then with the herein-described appliance. The following results were obtained.

In both cases the pouring of granulated chromium-containing material from the auxiliary chamber into the working one required almost 10 min.

The pouring over of grains from the working chamber into the auxiliary one, depending also on the rate of separation of the grains and articles on both occasions, required more time and under most unfavourable conditions, e.g. when chromizing 3000 articles of the bush type, 8.6 mm in diameter, took about 30 min. Since the cooling of these articles within the retort at a temperature ranging from 920° to 850° lasts more than 30 min, the pouring of the granular material for separating it from the articles, does not add much to the total duration of the working cycle.

Trial operation of a plant with a working chamber, 200 mm in diameter, revealed that with the total service period of about 500 hrs and chromizing temperatures of 900–1100° C the appliance shaped as a screw reliably precludes the pouring over of the granulated chromium-containing material from one chamber into another during: loading, chromizing proper and unloading of articles. It provides also, as compared with the valve, trouble-free operation of the proposed appliance. Within the entire service life, i.e. during 500 hrs, no traces of wear appeared on the screw surface, as prooved by inspection.

Technological trails of articles chromized in different gaseous atmospheres have shown that the process may be effected advantageously not only by using natural gas, but if it is not available, also with the use of an endothermic gas or dissociated ammonia gas or, finally, by using neutral gas alone (argon). Gas requirements for a single chromizing cycle are small, since they are needed mainly for blasting the retort while at other process stages their consumption is reduced almost to zero.

Given hereinbelow are the following examples illustrating chromizing in the proposed plant.

EXAMPLE

Chromizing was effected on the elements of chains for a ditch excavator preliminary subjected to carburizing (shafts 19 mm in dia, rollers from 33 to 25 mm in dia, bushes 25–19 mm in dia, in steel containing (weight percent): 0.4 carbon and 1 chromium. The treating conditions involved: loading of the above parts into a retort at a temperature of 800° C, chromizing at 950° C and holding for 6 hrs, hardening after cooling to a temperature of 830° C. The total processing cycle time amounted to 9.5 hours. As a result, the depth of a layer of chromium carbides obtained ranged from 0.020 to 0.025 mm, the surface hardness $H_{100}$, as-hardened, was 1600–1800 kg/mm², HRS ranged within 56–60. Abrasion bench trials of test parts showed that with the permissible wear of 1 mm the abrasion resistance increased 2.5 times, as compared with parts subjected to conventional heat treatment to obtain same hardness numbers.

EXAMPLE

Chromizing was effected on the elements of gas turbine burner nozzles from austenitic steel containing (weight percent): 12 chromium, 20 nickel, 3 titanium and doped by boron. The total number of parts amounted to 500 pieces. Treating conditions involved heating and cooling of the articles together with the retort, chromizing at a temperature of 1050° C and holding for up to 5 hrs. The depth of the thus-obtained layer varied from 0.035 to 0.040 mm, the hardness number along the layer section $H_{50}$ was in the range of from 1000 to 1050 kg/mm². The abrasion resistance of test parts was 20 times that of the parts produced from the same steel grade and subjected to conventional heat treatment.

EXAMPLE

Chromizing was effected in a semicontinuous cycle on mandrels and dies in steel containing, weight percent: 0.4 carbon, 5 chromium, manganese, vanadium and silicon, the above parts being adapted for extruding power cable sheathing. Three sets of the above-specified tools were chromized simultaneously. The treating conditions envisaged the loading of articles into a retort at a temperature of 700° C, chromizing at 1000° C and holding for 5 hrs at a rise in temperature to 1050° C prior to hardening (in a stream of compressed air). The depth of the thus-obtained layer of chromium carbides was 0.015 mm, hardness $H_{100}$, as-hardened, ranged from 1750 to 1800 kg/mm², HRC was 51–53. The abrasion resistance of the tools increased 4 times as compared with that of the same tools produced from more expensive steel containing (weight percent): 0.3 carbon, 2 chromium, 8 tungsten and vanadium, and subjected to conventional heat treatment.

Advantages attained in chromizing in the hereinproposed plant with the appliance shaped as a screw, in comparison with the now-existing chromizing technique with the use of containers with fuses, are as follows:

enhanced saturation rate;
better quality of chromized surface;
shorter processing cycle and enhanced output;
avoidance of labour-consuming manual operations;
alleviation of working conditions of operators;
mechanization of auxiliary operations and a possibility of automating the process as a whole;
the possibility of carrying out the chromizing process in a semicontinuous cycle;
the possibility of using complex regimes and of concurrent accomplishment of particular technological operations to be effected upon single heating;
lower consumption of chromium-containing material and lower power requirements.

What we claim is:

1. A plant for chromizing metal articles, comprising: a framework; a furnace secured on said framework and pivotally mounted about its transverse axis; a drive for reversibly pivoting said furnace about said transverse axis; a retort concentrically mounted within said furnace, said retort including a working chamber with a charging-and-discharging door and an auxiliary chamber, said chambers communicating through a relatively short, elongated throat section formed on said longitudinal axis; a cover closing said charging-and-discharging door of said retort; a screw element generally conforming to the length and diameter of said throat section and fixed therein, and a partition mounted in front of said screw on the side of said retort working chamber, said partition being provided with holes sufficient to let said grains of the chromium-containing material pass through but insufficient for the passage of articles to be treated; tubes for supplying gas into said retort; tubes for discharging gaseous products from said retort; tubes for introducing reagents into said working chamber and; a drive for reversible rotation of said retort about its longitudinal axis; whereby in one direction of pivot and a first direction of retort rotation said auxiliary chamber may be charged with said granular material, and in the reverse directions of pivot and rotation said grannular material charge may be transferred to said working chamber.

2. A plant of claim 1, wherein said element is shaped as a multiple-thread screw with each of its helices forming an angle of from 65° to 85° with its spinning axis.

3. A plant of claim 1, wherein said throat section comprises a sleeve member having an end surface thrusting against an annular collar provided on the internal surface of a reduced section of the retort wall, and said tubes comprising means mounted within each said chamber and concentric with the longitudinal axis thereof.

4. A plant of claim 3, wherein the ends of said sleeve are provided with shoulders whose outside diameter approximates the inside diameter of said reduced wall section.

* * * * *